US007815342B2

(12) United States Patent
Medinis

(10) Patent No.: US 7,815,342 B2
(45) Date of Patent: Oct. 19, 2010

(54) SURGICAL HEADLAMP

(76) Inventor: David M. Medinis, 9530 Gladiolus Blossom Ct., Fort Myers, FL (US) 33908

( * ) Notice: Subject to any disclaimer, the term of this patent is extended or adjusted under 35 U.S.C. 154(b) by 216 days.

(21) Appl. No.: 12/006,111

(22) Filed: Dec. 31, 2007

(65) Prior Publication Data

US 2009/0016045 A1 Jan. 15, 2009

Related U.S. Application Data

(63) Continuation-in-part of application No. 11/638,940, filed on Dec. 14, 2006, now Pat. No. 7,490,949.

(51) Int. Cl.
*F21V 29/00* (2006.01)

(52) U.S. Cl. ..... 362/294; 362/105; 362/373; 362/800; 362/804; 257/314; 361/699

(58) Field of Classification Search ..... 362/105, 362/106, 294, 373, 547, 800, 804; 165/104.33; 257/714–716; 361/699
See application file for complete search history.

(56) References Cited

U.S. PATENT DOCUMENTS 6,955,444 B2 * 10/2005 Gupta ..... 362/105
7,108,400 B2 * 9/2006 Yamada et al. ..... 362/294
7,192,151 B2 * 3/2007 Clupper et al. ..... 362/105
7,304,418 B2 * 12/2007 Nagata et al. ..... 362/800
7,490,949 B2 * 2/2009 Medinis ..... 362/105
2005/0243539 A1 * 11/2005 Evans et al. ..... 362/84

* cited by examiner

*Primary Examiner*—Stephen F Husar
(74) *Attorney, Agent, or Firm*—Edwin W. Oldham

(57) ABSTRACT

A surgical headlamp containing lamp housings, each containing multiple LED light sources is featured wherein the LEDs cooperate together to produce a light engine. The lamp housings may be adjusted so that light beams emitted by each LED be selectively converged through a focusing lens at a spot a predetermined distance in front of the lamp housings. Each lamp housing typically contains in addition to the LEDs, one or more focusing lenses to gather and direct the light generated by the LEDs forward to an illuminated work area. Batteries, preferably rechargeable, are mounted in a waist pack external to the headband, and are used to poser the LEDs. A cooling system for cooling the heat generated by the LED's is provided which utilizes a swirling effect of fluid adjacent a heat sink to transfer the heat to the swirling fluid.

4 Claims, 7 Drawing Sheets

SURGICAL HEADLAMP

This application is a continuation in part of application Ser. No. 11/638,940, filed on Dec. 14, 2006, now U.S. Pat. No. 7,490,949 which issued on Feb. 17, 2009, and hereby incorporated by reference.

I. BACKGROUND OF THE INVENTION

A. Field of Invention

The present invention pertains to lights that can be worn on a user's head to provide illumination in an area of work, and, more particularly, to a headlight for surgeons, dentists or other medical personnel or craftsmen. The light uses two independent lamp housings working cooperatively to converge light beams at a predetermined distance from the LED light sources.

It is essential in certain medical procedures that the physician, surgeon, or Dentist has his or her hands free for manipulating various surgical diagnostic or therapeutic instruments. At the same time, the particular part of the patient's body that the physician or surgeon is treating must be adequately illuminated. For these purposes, doctors and surgeons have heretofore utilized surgical head lights, some of which require the user to remain attached by via fiber optics to a free-standing light source, and/or to a power outlet or an energy source.

Battery powered head-mounted lamps utilizing an incandescent lamp as a light have also been used. Typically, the high power consumption, relatively low light output, high weight, and short battery life of each device of the prior art have made their use difficult, uncomfortable, or otherwise unsatisfactory.

Even with such configurations, however, the amount of light illuminating upon the work area can be inadequate. There have been attempts to increase the light pinching upon the work area by utilizing xenon or halide lamps, which require high power and have a relatively short bulb life and generate substantial amounts of heat.

Some of the problems associated with such xenon and halide lights may be overcome by utilizing light-emitting diodes (LEDs).

Some prior art apparatus have used relatively high-powered LEDs to generate sufficient light output. Such LEDs typically generate so much heat that a heat sink is required; heretofore the prior art has not been able to satisfy the repairment of a heat sink or cooling system for LED light generation.

B. Discussion of the Related Art

Several attempts to solve the problems described herein above have been made in the prior art. For example, published U.S. Pat. No. 6,055,444, published Jun. 2, 2005, and issued as a patent on Oct. 18, 2005 for Surgical Headlight by Suhil Gupta, teaches a head-mounted lamp assembly with at least two LEDs mounted side by side and focused utilizing a rear reflector. Such rear reflector use greatly diminishes the efficiency of the projection of the light generated by the LEDs and thus is unsatisfactory for providing a high intensity, focused light beam of the apparatus of the present invention.

U.S. Pat. No. 7,108,400 entitled Light Source Unit and Projector, by inventor Shuhei Yamada and Takeshi Seto, teaches the use of a LED light source for illumination of high luminants, which includes a cooling system for the illumination of high ruminants, which generates substantial heat. This design utilizes two liquid heat source absorbers and is very complex and is much more difficult to implement than that cooling system taught by the present invention.

U.S. Published Patent Application No. 2005/0243539 teaches a cooled light emitting apparatus comprising a light source including a close-packed array of light emitting diodes and a cooling system for cooling the light source. The cooling system is a thermoelectric cooling device in the form of a peltier device connected by a heat spreader to the light source and a heat exchange system for removing heat from the peltier device. The heat exchange system utilizes a liquid coolant to cool the peltier device in this instance the invention utilizes a heat pipe configuration or arrangement, and this is far less satisfactory than the liquid cooling system taught by the present invention.

II. SUMMARY OF THE INVENTION

In accordance with the present invention, there is provided a surgical headlight that overcomes the problems of head-mounted surgical headlamps of the prior art. A plurality of LED's are mounted in a circular arrangement on a printed circuit board that includes a metal substrate heat sink associated therewith that is in contact with a coolant chamber and a belt-mounted cooling liquid is pumped through the cooling chamber to control the heat output from the LED array mounted under and focused by a focus lens that is a single lens that focuses all of the diodes into a coherent focused pattern at a particular point of desired focus and intensity.

It is, therefore, an object of the invention to provide a head-mounted LED based headlamp for use by surgeons or other medical personnel, etc. It is another object of the invention to provide a head-mounted LED based headlamp comprised of a pair of individual lamp housings, each incorporating a plurality of LED cells and each unit mounted with associated with a focus lens that provides a 6" focus angle for an effective 200 mm circle of light at 440 mm.

It is a further object of the invention to provide a head-mounted LED-based headlamp powered by rechargeable batteries.

It is a further object of the invention to provide a head-mounted LED-based headlamp which has a bulb life of at least 50 times that of a xenon/halide bulb while operating at a less than ⅙ the wattage requirement of such xenon/halide bulbs.

It is a further object of the invention to provide a head-mounted LED-based headlamp which is very reasonable in cost and provides a significant solid-state semi-coherent light for passage through a focus lens at a 6°focus angle for an effective 200 mm circle of light at 440 mm.

III. BRIEF DESCRIPTION OF THE DRAWINGS

A complete understanding of the present invention may be obtained by reference to the accompanying drawings, when considered in conjunction with the subsequent detailed description, in which:

FIG. 6 is a perspective view of the headlamp of FIG. 1 showing two headlamps in side-by-side relationship: and.

Figure 11:
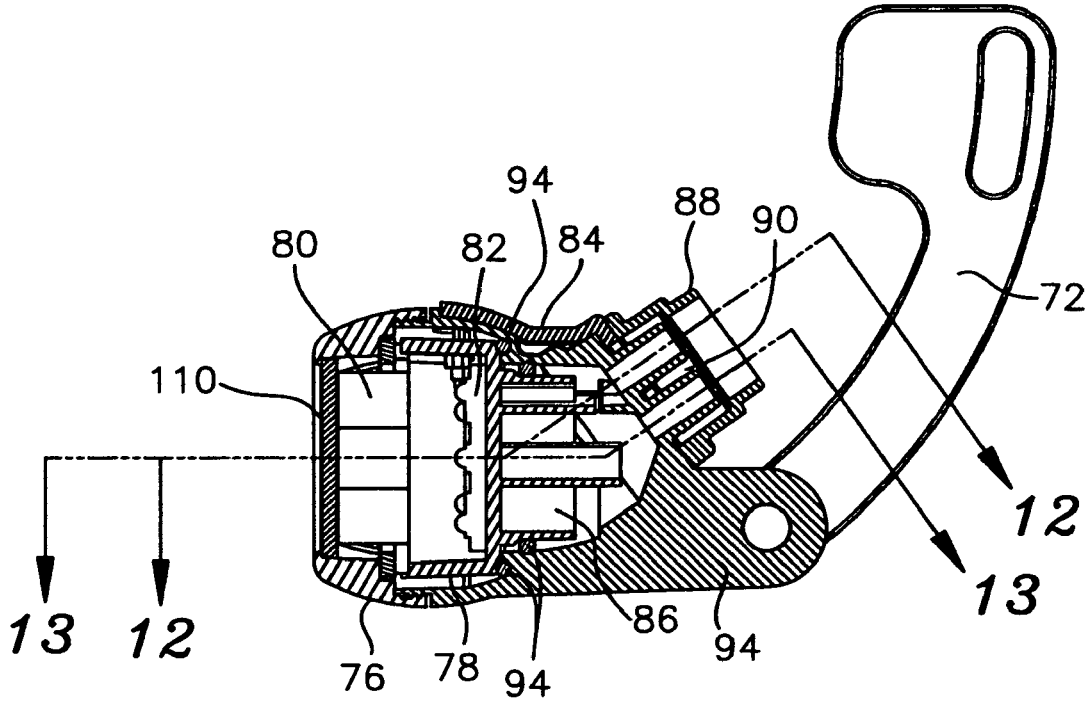
FIG. 11 is a side cross-sectional view of the headlamp taken on Line 11-11 of FIG. 8.
Figure 13:
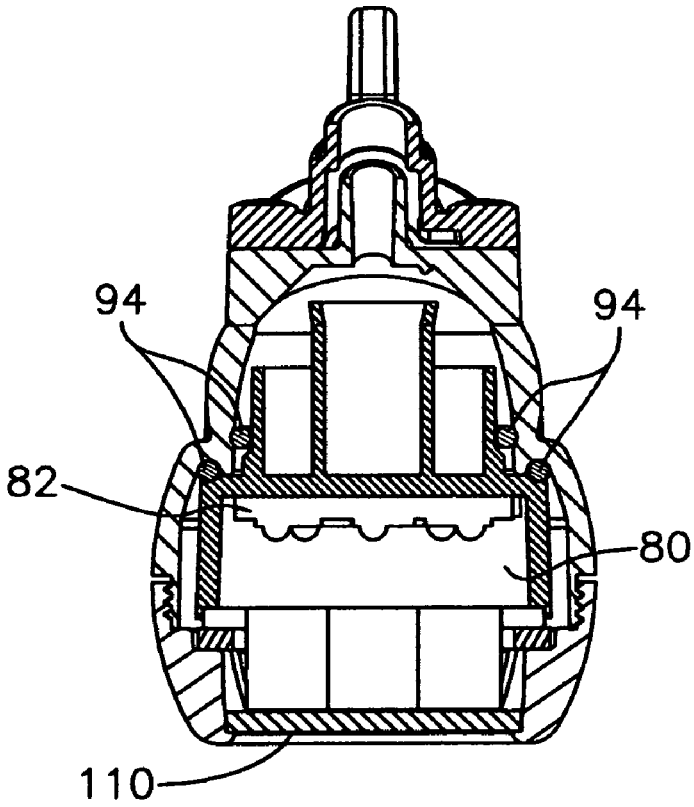

and FIG. 13 is a cross-sectional view of the headlamp taken on Line 13-13 of FIG. 11.

For purposes of brevity and clarity, components and elements of the apparatus of this invention will bear the same designations or numbering throughout the Figures.

IV. DETAILED DESCRIPTION OF THE PREFERRED EMBODIMENT

The present invention provides a surgical headlight which may be used by surgeons, physicians, dentists, etc., who require a reliable, portable, high density, battery-power light source. For the sake of brevity, the term surgeon is used hereinafter to refer to any user of the head-mounted headlamp of the invention.

Figure 1:
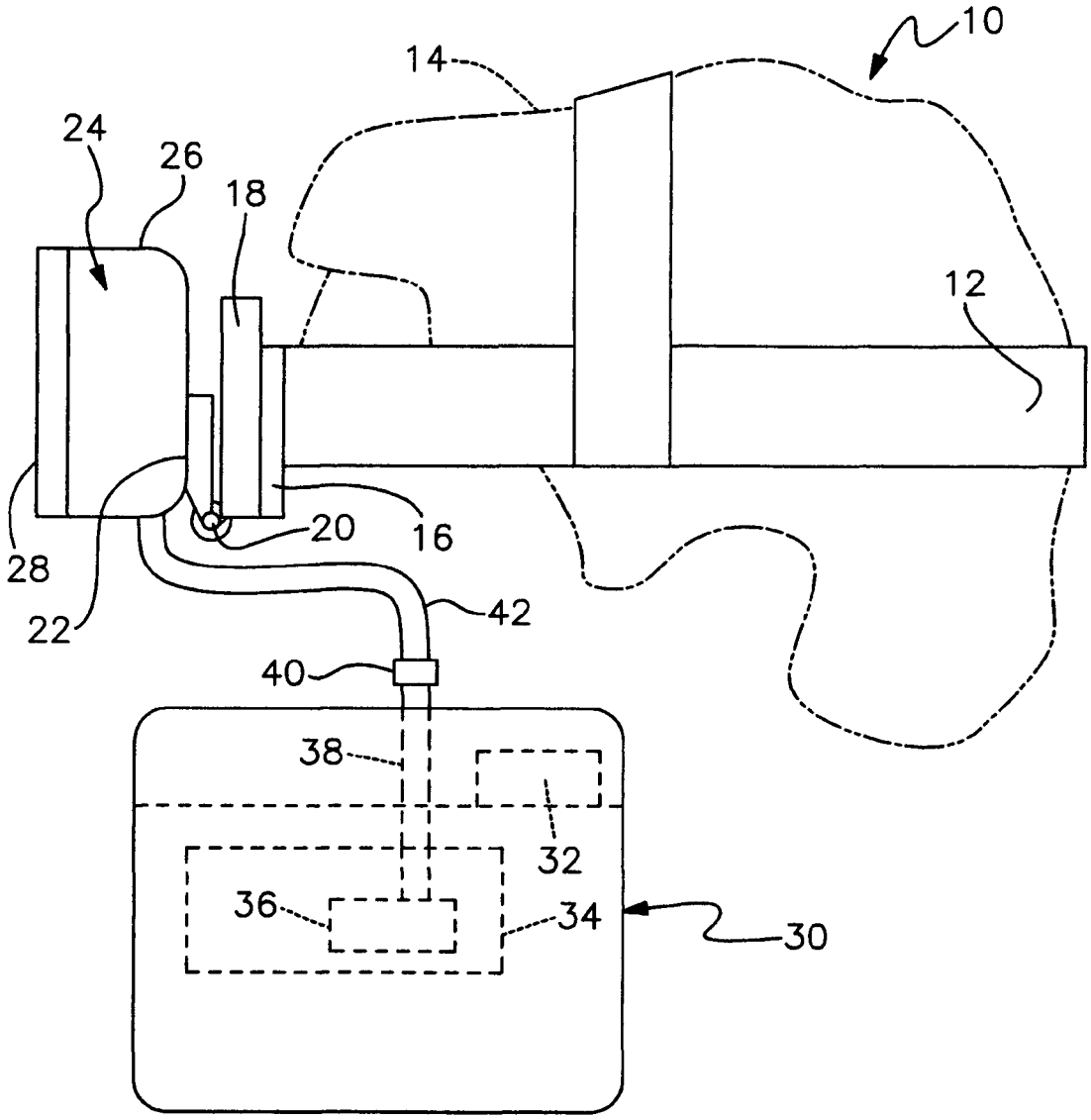
FIG. 1 is a side view in schematic form of the headlight assembly system of the invention showing the head mount strap, the headlight itself and the remotely located cooling and battery powered system assembly.

Referring first to FIG. 1 of the drawings, 10 indicates generally the head-mounted headlamp of the invention which comprises a basic band 12 to go around the head and forehead of the user, and this band 12 is normally adjustable to be able to therefore fit the size of the wearer of the unit. A top strap 14 is shown, which goes over the top of the head of the user and stabilized the whole assembly to fit comfortably and securely onto the user's head, in much the typical way of any of these devices.

Figure 6:
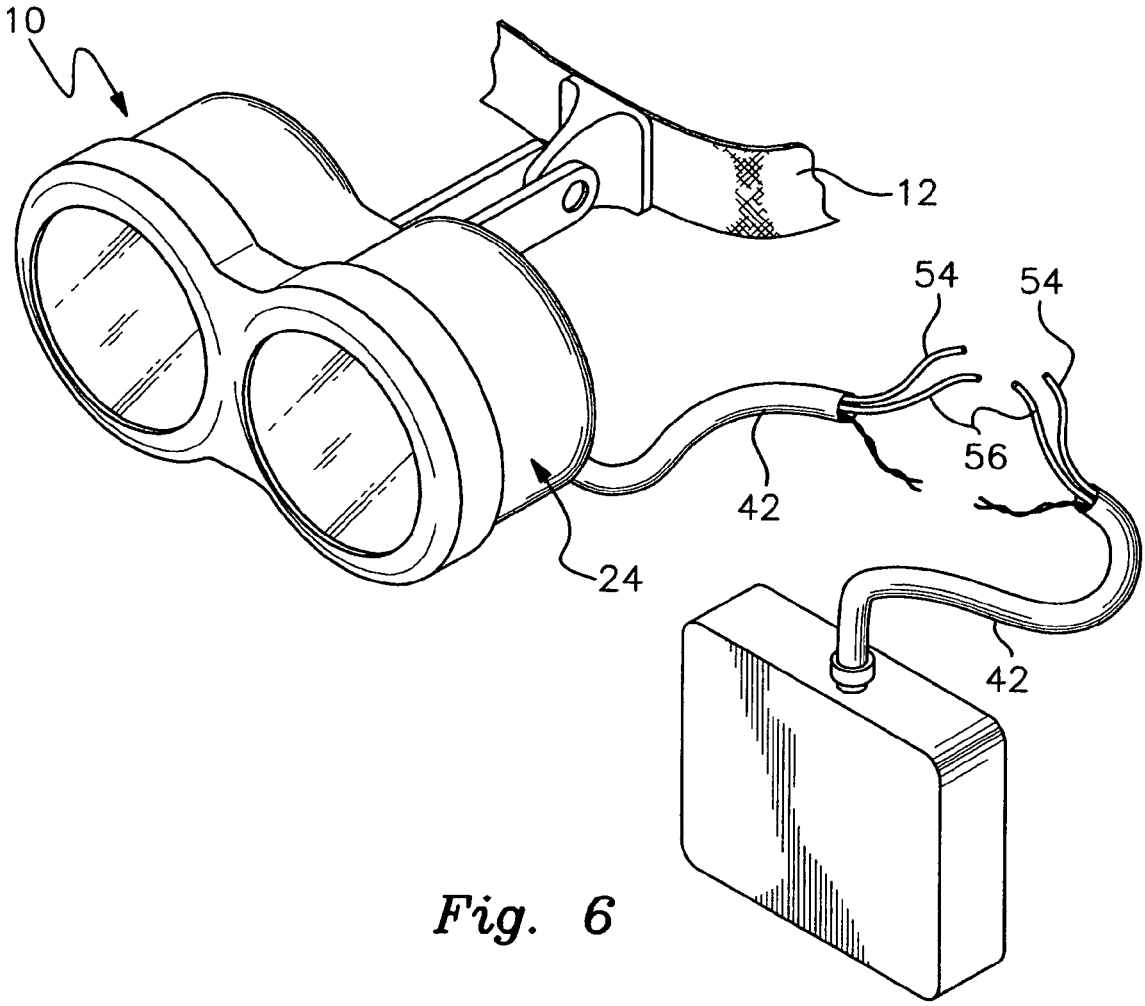

The band 12 mounts then to a mounting plate 16 which attaches itself to a further forehead plate 18 and plate 18 operates through a ratcheting swivel 20 to provide an actual mounting plate 22 which carries the improved head-mounted headlamp 24 of the invention. The basic headlamp 24 is composed of two separate lamps 24, as best seen in FIG. 6. The basic headlamp is comprised of a rearward housing 26 which carries the actual LED configuration and cooling, to be described later, and a front protective cover for the focusing lenses as described in conjunction with FIG. 4.

The auxiliary package is indicated generally by 30 and this is remotely mounted, normally on the waist or the back, through a belt arrangement typically suitable for the user. This auxiliary package incorporates a LED power supply 32 is a conventional rechargeable battery typically used for this type of system and is conveniently located for replacement or recharging in the box assembly 30. The box 30 also incorporates a coolant reservoir 34, again shown in dotted line, and coolant reservoir incorporates a coolant pump 36, again shown in dotted line and the pump 36 transmits coolant through a coolant tube 38, also indicated by dotted line within the box 30 and then there is a quick connect or disconnect unit 40 located between the flexible tubing that constitutes the tubing 42 that sends the coolant fluid up and into its appropriate use for cooling in the headlamp assembly 24.

Figure 2:
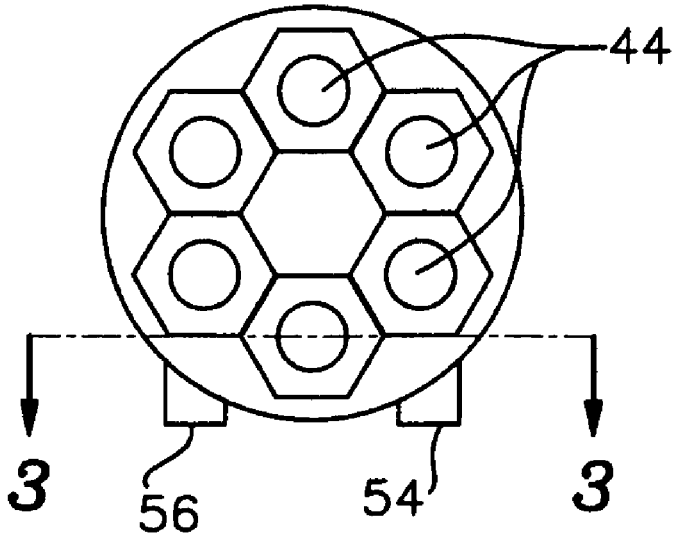
FIG. 2 is a top schematic view of the headlight assembly utilized as one of the two assemblies associated with the headlamp of the invention and showing the focus lenses, each individually hexagonal in shape, and arranged into a hexagonal circular shape with the six lenses toughing on the flat outer sides, as shown.
Figure 3:
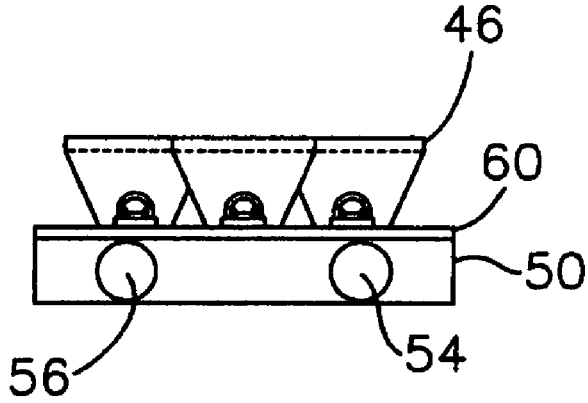
FIG. 3 is a side cross-sectional elevation, taken on line 3-3 of FIG. 2 of the three LEDs associated with one side of the headlamp and showing the construction the focusing lenses and the heat sink associated therewith as well as the cooling chamber.
Figure 4:
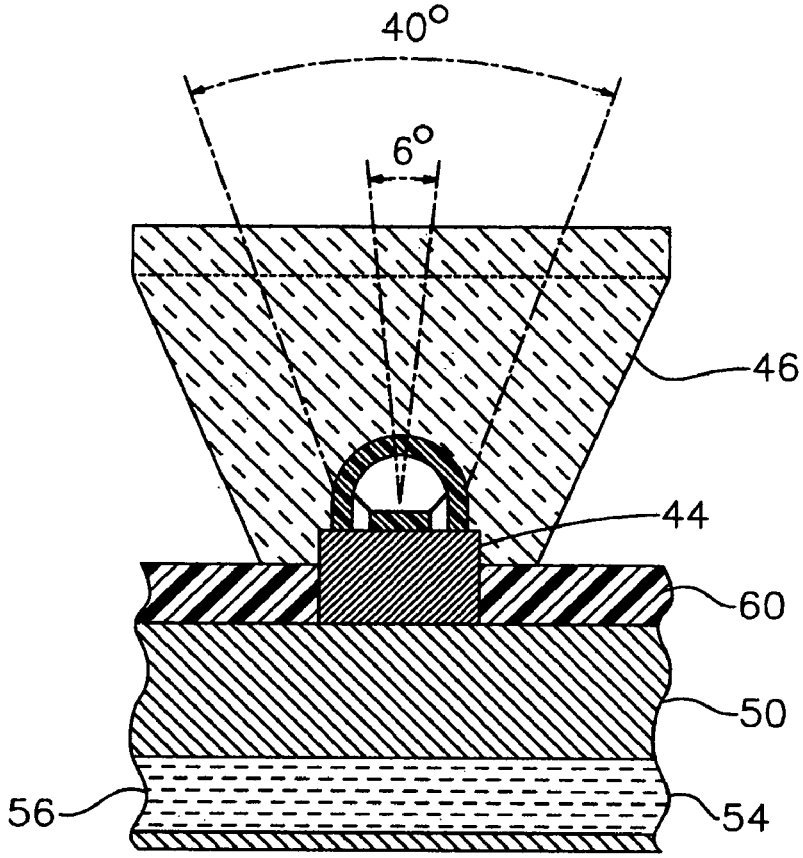
FIG. 4 is a cross-sectional elevation showing of one of the focusing lenses showing the relationship between the cone of light emission from the LED and the resultant condensing of that emission into a focused cone of light achieved by the focusing lens.
Figure 5:
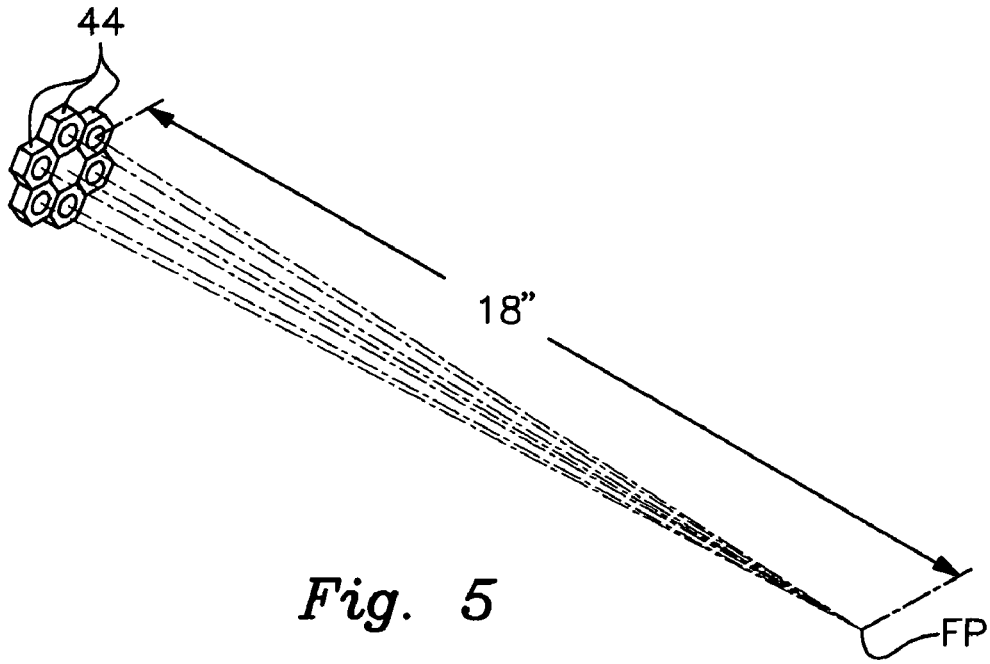
FIG. 5 is a schematic perspective showing of the six LEDs in hexagonal array, and each pointed at the specific focal point desired.

Referring now to the headlamp assembly 24 shown in FIG. 2 of the drawings, the headlamp includes a plurality of LED's indicated by 44. The LEDs are mounted in a hexagonally-shaped focusing lens 28 that comprises a plurality of independent lenses 46 associated with each LED. The lens 28 is preferably a solid polymer molding to incorporate six individual lenses 46, all physically connected to a central hexagon piece 47, all as one overall piece by a separate mold that locates the lenses as shown in FIG. 5 so as to focus at a point approximately 18 inches from the lenses 46. This will be explained in more detail with respect to the drawings shown in FIGS. 3 and 4.

Figure 7:
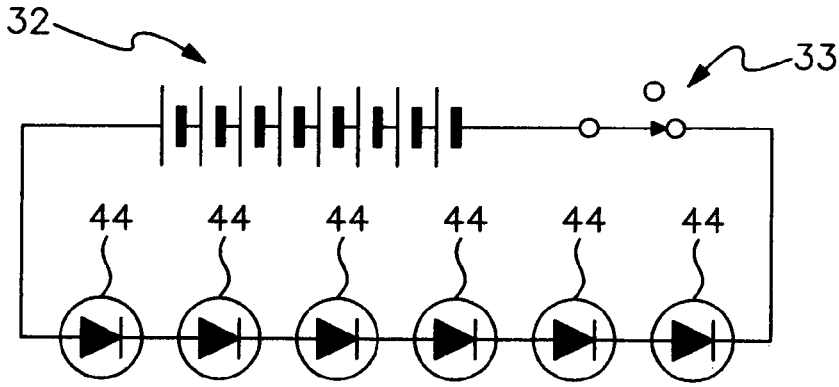
FIG. 7 is an electrical diagram of the headlight assembly showing the battery, the LEDs, the pump and an on-off switch.

The LEDs 44 are wired in series to the power supply, as shown in FIG. 7, with an with an on-off switch 33, and this switch 33 also simultaneously turns on the fluid pump 36. The solid-state, semi-coherent light passes through the focusing lens 46 at a 6° focus angle for an effective 200 mm circle of light at 440 mm. The alignment of the LEDs 44 and the focusing lenses 46 is best seen in FIG. 4 where it shows that the LEDs actually put out an approximately 80° cone of semi-coherent light, which is condensed into a much narrower approximately 6° of conical light with each respective LED focused at the same point, as shown in FIG. 5. These actual distances and relationships can be varied depending upon the particular focus characteristics of the focus lenses 46. It is important to the proper functioning of the LEDs that the LEDs draw no more than about 50 watts of battery power and preferable the battery 32 will be between 12 and 24 volts to produce a load of 1 amp to power each of the 12 LEDs in the two-unit headlamp 24.

Referring again to FIG. 7 of the drawing, the battery 32 is connected through the closing of switch 33 to provide 1 amp in power to the LED array. The LEDs are each preferable of 5 watt power output. The LEDs 44 working together form a light engine for each of the headlamps 24 of FIG. 6. The LEDs 44 are activated and emit bright semi-coherent light through the focus lenses 46 now probably best seen in both FIGS. 3 and 4. This light is then emitted to the focus lenses 46, as best seen in FIG. 4. It is important to note, also, that the semi-coherent light emitted by the LEDs is in a lamberton distribution.

The heat generated from the LEDs is drawn out through an aluminum heat sink layer 50. With the coolant flowing in the coolant chamber 52, excess heat is carried away from the assembly via the coolant output 54 and coolant input 56, which brings the coolant into the chamber 52. Coolant input 56 and output 54 are connected to a coolant reservoir and pump with flexible tubing, as already described with respect to FIG. 1. The coolant can be water, and it has been found that the flow rate of 400 ml per minutes works very well.

Figure 8:
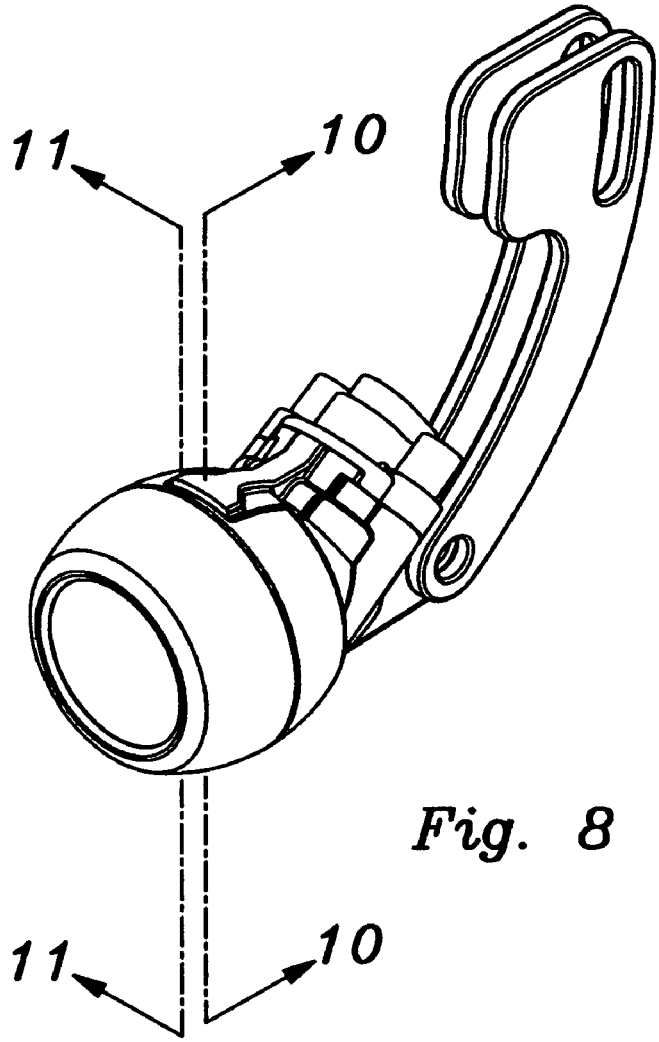
FIG. 8 is a perspective view of a single headlamp that shows the relationship of the light to the mounting bracket and includes all the components described above with respect to the other modification of the headlamp.
Figure 9:
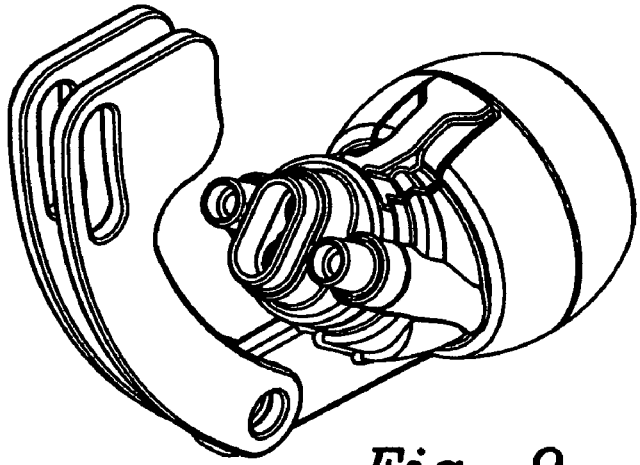
FIG. 9 is a second perspective taken from the back side, showing the cable guide, mounting bracket and the openings into the back of the headlamp over the cooling fluid passage and the electrical connection for the LEDs.
Figure 10:
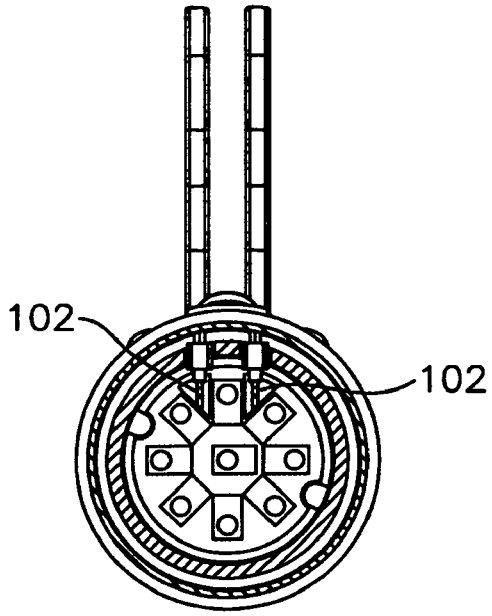
FIG. 10 is a cross-sectional view of the portion of the headlamp that is taken on Line 10-10 of FIG. 8.

Referring to FIGS. 8 and 9, these represent perspective views of a single headlamp design that is reduced in size and weight and still puts out a very large condensed beam through the focused lenses and appears to be more operable and a better more modern design to the headlamp. It is designed in this instance to be a 20 mm surgical headlamp. Referring to FIGS. 10 and 11, and particularly at FIG. 11, numeral 70 indicates the general headlamp, which comprises a mounting bracket 72, a main casing 74, a front cap 76, an aluminum heat sink 78, an optical focus lens 80, light emitting diode aluminum substrate printed circuit board 82, an insert 84 to the printed circuit board 82 which provides a cover for electrical conductors 100 from the LED printed circuit board 82. The cooling chamber is identified by numeral 86, and the tubing cap by numeral 88. A cooling chamber input-output lumen is identified by numeral 90. A mounting flange for the main casing is identified by numeral 72, and O-rings and sealing gaskets 94 isolate the cooling chamber from the LEDs and any other constituents in the headlamp 70.

Cooling fluid and electrical power enter into the tubing cap 104, where the fluid flows into the cooling chamber 86, and the electricity is conducted to two copper inserts molded inside the conductor insert at 102. The power is then transferred to the LED printed circuit board 82 through the connector 102 and the connector 100 protected under the insert 84, The coolant flows into the cooling chamber 86 and carries away heat generated by the LED printed circuit board 82. The coolant is isolated using the seals and gaskets 94. The light generated by the LED passes through the optical focus lens, where it is focused into a 100 mm circular pattern 440 mm in front of the lens. The main casing of light 70, is secured to a mounting bracket 74 using a fastener and the mounting flange 72.

Figure 12:
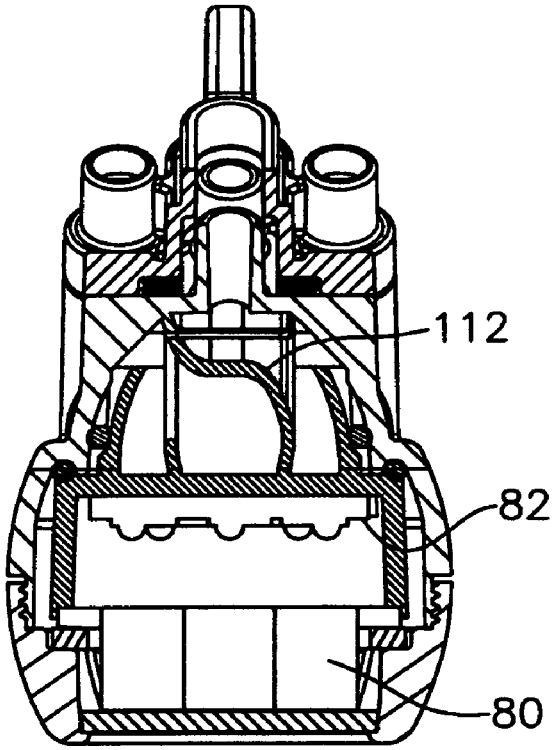
FIG. 12 is a cross-sectional configuration of the headlamp taken on Line 12-12 of FIG. 11.

An important feature of this design because of the reduced size of the headlamp itself being a diameter across the covering lens 100, of about 20 mm, there is less space for the coolant to flow, and therefore the design incorporates a means to swirl and/or create a funnel configuration with the water entering the cooling chamber so that there is a swirling motion of the water to act as a better transfer agent for heat from the LEDs. This is achieved by the swirling obstruction 112 , seen in FIG. 12 and this creates the swirling effect of the cooling fluid and the cooling chamber. The cooling chamber is sealed from the rest of the housing by the O-rings shown in FIG. 13.

Since other modifications and changes vary to fit particular operating requirements and environments, it will be apparent to those skilled in the art that the invention is not limited to the examples chosen for purposes of disclosure and covers all changes and modifications which do not constitute departures from the true spirit and scope of the invention.

Having thus described the invention, what is desired to be protected by letters patent is presented in the subsequently appended claims.

What is claimed is:

1. A headlamp for projecting focused light in a collected beam at a specific distance from the headlamp which is comprised of:

a solid state light source consisting of LEDs producing a semi-coherent distribution of emitted light, a printed circuit board connecting each LED in series electrical connection, a focus lens arranged in front of the light source and focusing all emitted light in a substantially circular pattern from said LEDs and at a specific desired distance from the said LEDs' emitted light, means to provide electrical energy to light each respective LED through the printed circuit board, and means to cool the respective LEDs to maintain a suitable operating temperature, such means comprising a cooling chamber which includes structural cooling fluid diverters to create a spiral effect of the cooling fluids into a turbulent, swirling motion to effect the transfer of heat from the cooling chamber away from the LEDs.

2. A headlamp according to claim 1 wherein the means to cool includes a reservoir, metallic heat sink layer immediately adjacent each LED, and in contact with the electrical connection, contact to the respective LEDs, and a pump to pass the fluid adjacent the heat sink layer through the swirl and funnel effect located within the cooling chamber.

3. A headlamp according to claim 2 wherein the heat sink layer is between 2.0 mm to 2.5 mm thick, and the printed circuit board is between 1.0 mm to 1.5 mm in thickness.

4. A headlamp according to claim 1 wherein the fluid is pumped at 400 mm per minute to provide the cooling of the LEDs required for optimum performance, but includes the swirling effect to achieve the proper cooling in the cooling chamber.

* * * * *